US006923127B2

(12) United States Patent
Smith

(10) Patent No.: US 6,923,127 B2
(45) Date of Patent: Aug. 2, 2005

(54) ANTI-PRYING DEVICE FOR USE WITH A SAFE

(75) Inventor: Mike Smith, Scottsburg, IN (US)

(73) Assignee: Fire King International, New Albany, IN (US)

( * ) Notice: Subject to any disclaimer, the term of this patent is extended or adjusted under 35 U.S.C. 154(b) by 102 days.

(21) Appl. No.: 10/723,902

(22) Filed: Nov. 26, 2003

(65) Prior Publication Data

US 2005/0109252 A1 May 26, 2005

(51) Int. Cl.[7] ..... E05G 1/00

(52) U.S. Cl. ..... 109/50; 16/380; 292/259 R; 292/338; 49/383

(58) Field of Search ..... 109/49.5, 50; 70/94, 70/416–418; 16/380, 381, 262, 263, 223; 292/259 R, 291, 288, 289, 338, 339, DIG. 17; 49/383

(56) References Cited

U.S. PATENT DOCUMENTS

| | | | | | |
|---|---|---|---|---|---|
| 314,105 | A | * | 3/1885 | Carnes | 16/223 |
| 485,613 | A | * | 11/1892 | Deane | 16/353 |
| 3,206,793 | A | * | 9/1965 | Silverberg | 16/223 |
| 3,636,659 | A | * | 1/1972 | Bylicki | 49/383 |
| 3,710,736 | A | * | 1/1973 | Biondi et al. | 109/50 |
| 3,715,998 | A | | 2/1973 | Teleky | |
| 3,811,150 | A | * | 5/1974 | Chalmers | 16/352 |
| 3,911,622 | A | * | 10/1975 | Prohaska | 49/383 |
| 3,937,506 | A | * | 2/1976 | Dean | 292/300 |
| 3,945,329 | A | | 3/1976 | Bywater | |
| 3,971,100 | A | * | 7/1976 | Anop | 16/375 |
| 4,014,571 | A | * | 3/1977 | Ellis | 292/300 |
| 4,018,306 | A | | 4/1977 | Lyons | |
| 4,063,330 | A | * | 12/1977 | Triplette | 16/321 |
| 4,108,087 | A | | 8/1978 | Sebesta | |
| 4,284,014 | A | | 8/1981 | Kuhn | |
| 4,327,651 | A | | 5/1982 | Novakosky | |
| 4,455,846 | A | * | 6/1984 | Wichinsky | 70/94 |
| 4,584,739 | A | | 4/1986 | Könen | |
| 4,741,454 | A | * | 5/1988 | Ray et al. | 220/315 |
| 5,020,450 | A | | 6/1991 | Lichter | |
| 5,036,685 | A | * | 8/1991 | Napolitano | 70/161 |
| 5,060,583 | A | | 10/1991 | Stinson | |
| 5,131,189 | A | | 7/1992 | Mascotte | |
| 5,265,448 | A | * | 11/1993 | Fontenot | 70/14 |
| 5,265,922 | A | * | 11/1993 | Falcone | 292/258 |
| 5,327,682 | A | | 7/1994 | Holtz | |
| 5,337,453 | A | | 8/1994 | Bargesser | |
| 5,398,982 | A | * | 3/1995 | Watson, Jr. | 292/259 R |
| 5,427,422 | A | * | 6/1995 | Madlener et al. | 292/264 |
| 5,503,088 | A | | 4/1996 | Hayman | |
| 5,642,910 | A | * | 7/1997 | Betherum | 292/288 |
| 5,676,410 | A | * | 10/1997 | Angerbrandt | 292/338 |
| 5,845,433 | A | | 12/1998 | Walsh | |
| 5,873,273 | A | * | 2/1999 | Vick | 70/101 |
| 5,931,104 | A | | 8/1999 | Horn et al. | |
| 6,134,839 | A | * | 10/2000 | Johansson | 49/383 |
| 6,298,605 | B1 | * | 10/2001 | Delefosse et al. | 49/383 |
| 6,643,980 | B1 | * | 11/2003 | Dorder et al. | 49/383 |
| 2003/0205001 | A1 | * | 11/2003 | Williams et al. | 49/383 |

* cited by examiner

*Primary Examiner*—Suzanne Dino Barrett
(74) *Attorney, Agent, or Firm*—Brooks Kushman P.C.

(57) ABSTRACT

An anti-prying device for limiting thefts caused by prying a safe from its anchorings. The anti-prying device including a member which is extended between a safe protrusion and a floor. The anti-prying device limits access between the floor and the safe protrusion to limit inserting a prying element therebetween.

21 Claims, 2 Drawing Sheets

ANTI-PRYING DEVICE FOR USE WITH A SAFE

BACKGROUND OF THE INVENTION

1. Field of the Invention

The present invention relates to devices for use with a safe to prevent the safe from being pried or otherwise uprooted from its anchorings.

2. Background Art

A safe is an enclosure used to keep articles for safe-keeping. Thieves have been know to steal the articles stored within safes. In some case, rather than breaking the safe's lock, thieves have been know to steal the safe by prying the safe from its anchorings. The entire safe is then stolen once it is uprooted from its anchorings.

One such prying example relates to inserting a prying element between a door hinge and the surface to which the safe is secured, typically the floor. Once so positioned, the prying element can be wedged and worked against the door hinge and the floor to uproot the safe from its anchorings.

The prying element can be any device which is capable of applying sufficient force between the hinge and the floor to uproot the safe. A hydraulic jack is one such device. The jack applies force by expanding itself jack between the door hinge and the floor. As the hinges are typically very strong, the upwardly expanding jack causes the hinge to raise the safe up from the floor such that the anchorings are pulled out of the floor.

There are a number of safes in use which may be susceptible to being uprooted from their anchorings and stolen in this or a similar manner. Thus, there exists a need for an anti-prying device which can prevent the uprooting of safes. Because the safes in use today are typically already anchored in position, it is desirable to provide an anti-prying device which can be retrofitted as an after-market item without incurring the additional expense of re-anchoring the safe.

In addition, as many of the currently used safes are scheduled for replacement with new safes which may be similarly susceptible to being uprooted from the anchorings, it is also desirable to provide an anti-prying device which can be used with replacement safes without requiring additional removal or modification.

Thus, it is desirable to provide an after-market anti-prying device that allows for the replacement of existing safes without requiring that the anti-prying device be removed or modified and that also prevents uprooting and stealing of the safe by jacking up or otherwise prying up the safe.

SUMMARY OF THE INVENTION

It is, therefore, an object of the present invention to provide an after-market anti-prying device that allows for the replacement of existing safes without requiring that the anti-prying device be removed or modified and that also prevents uprooting and stealing of the safe by jacking up or otherwise prying up the safe.

One aspect of the present invention relates to an anti-prying device being a member that is positioned between a protrusion on the safe and a floor to which the safe is secured. Preferably, the protrusion is a door hinge and the member is extended relative to the door hinge to restrict insertion of a prying element between the door hinge and the floor.

In this manner, a prying element is substantially prevented from being wedgeable and workable between the door hinge and the floor. The inability to insert the prying element thereby incapacitates the prying up of the safe from. For Example, the anti-prying device can prevent the insertion of a jack between the door hinge and the floor, thus preventing the jack from prying up the safe.

The member can comprise a base portion and a rod. Preferably, the base portion is secured to a portion of the floor in front the safe. The rod extends away from the base portion and is sufficiently dimensioned to extend between the door hinge and the floor. The base portion holds the rod in position, and the rod in turn restrict insertion of the prying element between the door hinge and the floor.

The member can include a number of apertures in the base. The apertures can be used to receive a corresponding number of anchors to anchor the base to the floor. Any number of anchors can secure the base to the floor. Preferably, the anchors are of a non-removable type, such as expandable bolts or one-way/headless screws.

The rod and base can include any suitably strong material. Preferably, it is sufficiently rigid to prevent being bent, such as steel. Such rigidity can be helpful in preventing the use of a prying element to bend the rod relative to the axis of the door hinge so as to prevent bending the rod out of the way for insertion of a jack.

The rod can be sufficiently dimensioned widthwise to cover an area between the safe door and the hinge. This can further help prevent bending of the rod by preventing the inserting of a prying element between the door and the rod.

One aspect of the present invention relates a method for preventing stealing of a safe. The method can be used for preventing stealing of a safe caused by inserting a prying element between a door hinge of the safe and a surface to which the safe is anchored. The method generally prevents stealing caused by wedging and working the prying element against the hinge and-the surface to uproot the anchored safe.

The method includes providing an anti-prying element device having a base and a rod extending from the base. The anti-prying element is then aligned with the door hinge such that the rod is aligned substantially co-axially with the hinge to restrict insertion of the prying element between the door hinge and the surface. With the rod alignment, the prying element is prevented from being wedgeable and workable between the door hinge and the surface. The base is then anchored once the anti-prying device is aligned. In this manner, the anti-prying element can be added to previously installed safes to protect the safes against theft.

DETAILED DESCRIPTION OF THE PREFERRED EMBODIMENT(S)

Figure 1:
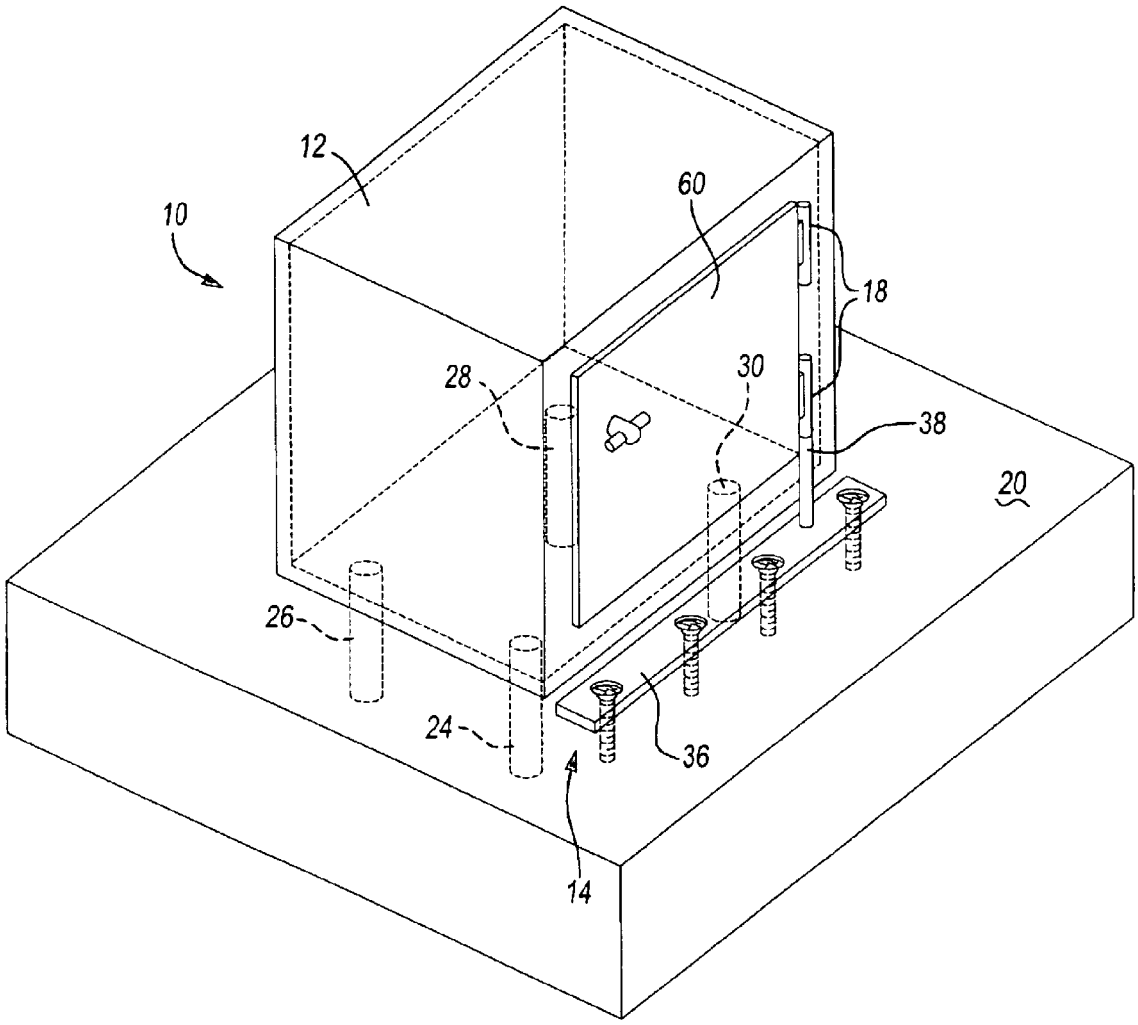
FIG. 1 illustrates safe system in accordance with the present invention.

FIG. 1 illustrates safe system 10 in accordance with the present invention. Safe system 10 generally comprises safe 12 and anti-prying device 14. Safe 12 can include any type of safe which includes an enclosure for storing and protecting articles.

Thieves have been know to steal the articles stored within safes. In some case, rather than breaking the safe's lock, thieves have been know to steal the safe by prying the safe from its anchorings. The entire safe is then stolen once it is uprooted from its anchorings.

Anti-prying 14 device is intended to limit stealing of safe 12 from insertion of a prying element (not shown) between door hinge 18 and floor (surface) 20. This type of thievery has been known to be used by thieves to uproot safe 12 from its anchorings 24, 26, 28, and 30. Once safe 12 is uprooted from its anchorings, it can be carried away (stolen).

The prying element can be any device which is capable of applying sufficient force between hinge 18 and the floor 20 to uproot safe 12. A jack is one such device. The jack is operable to apply prying force by expanding between door hinge 18 and floor 20. Anti-prying device 14 prevents the insertion of a jack or other prying element between hinge 18 and surface 20.

Figure 2:
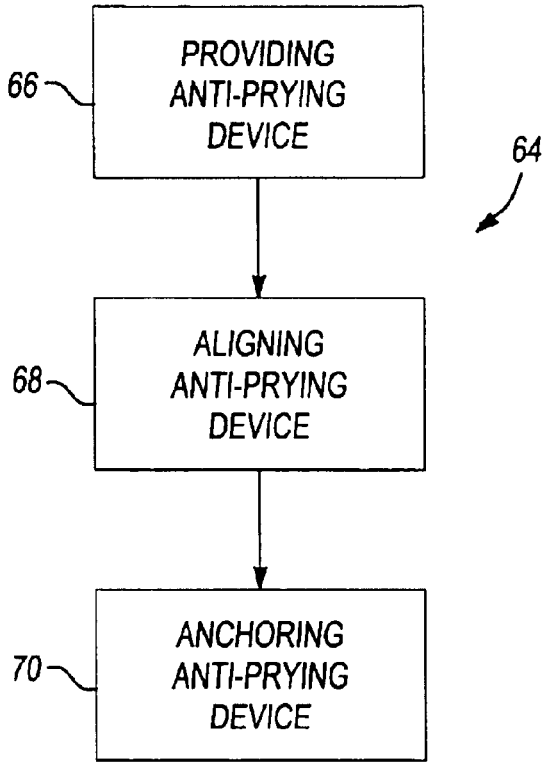
FIG. 2 illustrates anti-prying device in accordance with the present invention.

FIG. 2 illustrates anti-prying device 14. Anti-prying device 14 includes base 36 and rod 38. Rod 38 extends away from base 36 in a generally perpendicular fashion. Rod 38 is typically welded to base 36, but it could be attached thereto or formed integral thereto by other means.

According to one aspect of the present invention, rod 38 extends proximate hinge 18 without interfering with operation of hinge 18. Rod 38 is shown as being rounded, however, rod 38 may comprises any shape or configuration and it need not extend away from base 36 in only a perpendicular fashion. More than one rod 38 can be used with a single base 36.

Base 36 includes a number of apertures 40, 42, 44, and 46 for receiving anchors 50, 52, 54, and 56 to anchor base 36 to floor 20. In some cases, the anchors can be non-removable bolts or other fastening devices, such as one-way or headless bolts.

Alternatively, holes can be drilled into surface 20 such that the anchors can be inserted and covered with a solidifying compound to secure the bolts therein. Expanding bolts can be also used. Expanding bolts are inserted in correspondingly drilled holes and tightened such that outward pressure is exerted against the drilled holes to secure the bolts therein.

Rod 38 is also preferably sufficiently sized to prevent insertion of a pry-bar or other element between door 60 and rod 38. Generally, the dimensioning is sufficient to cause rod 36 to extend from door 60 to at least the front outer portion of hinge 18 so that no portion hinge 18 is accessible to a jack.

Anti-prying device 14 is preferable made of sufficiently strong material, such as steel or iron. It is preferably positioned in front of safe 12 so that rod 38 is co-axially aligned with door hinge 18. However, all that is required is that rod 38 be sufficiently positioned relative to hinge 18 to prevent prying up of hinge 18.

Advantageously, anti-prying device 14 guards against theft without interfering with operation of safe 12. In this manner, anti-prying device 14 is especially beneficial as an after market addition to previously installed safes.

Moreover, it can be easily positioned and anchored to surface 20. Because anti-prying device 14 is not secured to safe 12, safe 12 can be replace without requiring removal or modification of anti-prying device 14.

Figure 3:
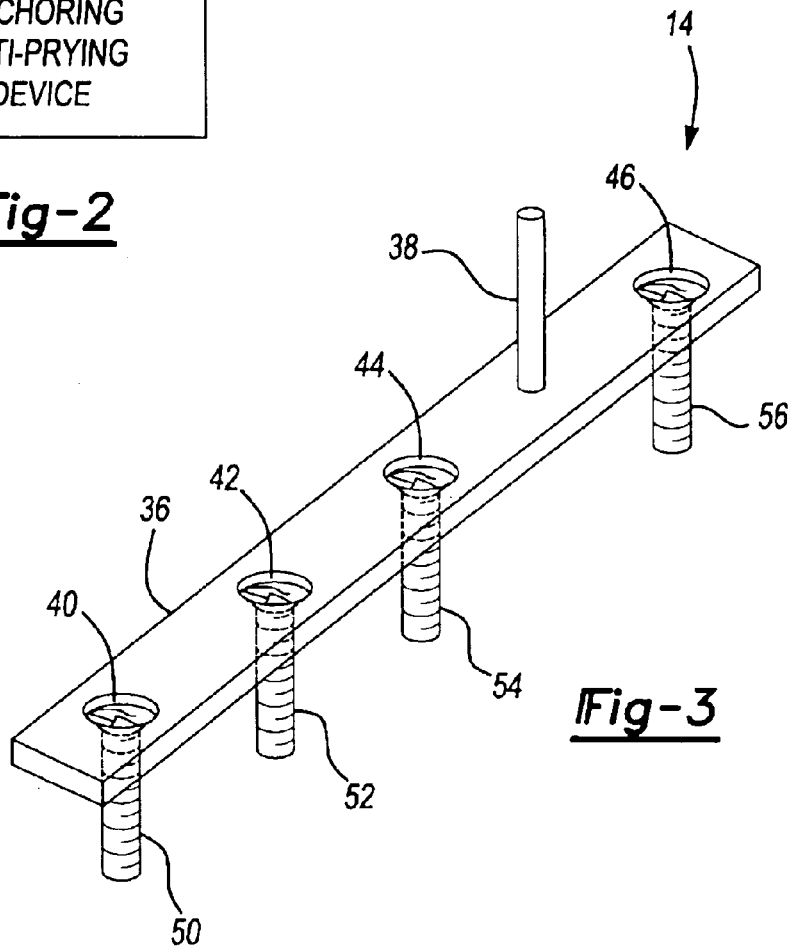
FIG. 3 illustrates a flowchart for preventing stealing of a safe by prying the safe from its anchorings.

FIG. 3 illustrates a flowchart of a method for preventing stealing of a safe. The method can be-used for preventing stealing of a safe caused by inserting a prying element between door hinge 18 and floor 20.

The method is particularly suitable to prevent stealing caused by wedging and working the prying element against the hinge and the surface to uproot the anchored safe. The method, however, is not so limited. Rather, it can be use in other applications to prevent similar uprooting and theft.

Block 66 relates to providing an anti-prying element device having a base and a rod extending from the base. Preferably, block 66 relates to providing anti-prying device 14.

Block 68 relates to aligning the anti-prying element provided in block 66 with a door hinge. Preferably, the rod is aligned co-axially with the hinge to restrict insertion of the prying element between the door hinge and the surface.

With the rod alignment, the prying element is substantially prevented from being wedgeable and workable between the door hinge and the surface. Depending on the size and shape of aligned anti-prying device, however, the rod may not need to be co-axially aligned with the hinge. For example, if the rod is sufficiently large, it may have its axis offset laterally relative to the axis of the door hinge.

Block 70 relates to anchoring the base once the anti-prying device is aligned. The anchoring preferably includes using a non-removable anchor, such as an expandable bolt or one-way or headless bolt. In this manner, the anti-prying element can be added to previously installed safes to protect the safes against theft while also being difficult to remove by thieves.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An anti-prying device to limit wedging and working of a prying element between a protrusion on a safe and a surface to which the safe is secured, the device comprising:

a member extending between the protrusion and the surface to restrict insertion of the prying element between the protrusion and the surface such that the prying element is substantially prevented from being wedgeable and workable between the protrusion and the surface to prevent uprooting the safe from its anchorings;

wherein the member includes a base portion and a rod, the rod being an elongated member that extends lengthwise away from the base portion in only a perpendicular direction, the rod being permanently secured to the base portion in a fixed position such that the rod is fixed lengthwise in an upward position to prevent the prying element from being inserted between the rod and the surface.

2. The device of claim 1 wherein the member further comprises a number of apertures in the base and a number of anchors inserted through the apertures to secure the base to the surface.

3. The device of claim 1 wherein the anchors are non-removable bolts.

4. The device of claim 2 wherein the anchors are expandable bolts which are expanded against a hole in the surface to secure the bolts therein.

5. The device of claim 1 wherein the protrusion is a door hinge for pivotably opening a door of the safe, the member extended between the door hinge and the surface to restrict insertion of the prying element between the hinge and the surface without interfering with operation of the hinge.

6. The device of claim 1 wherein the protrusion is a door hinge and the member includes a rod extending from a base co-axially with the door hinge and between the door hinge and the surface.

7. The device of claim 5 wherein the rod is sufficiently rigid to prevent being bent by a prying element relative to the axis of the door hinge.

8. The device of claim 5 wherein the rod is sufficiently dimensioned to cover an area between a safe door opened by the door hinge and an outer front portion of the door hinge to prevent a prying element from being inserted between the door and the rod.

9. A safe system, the system comprising:

a safe for receiving articles for safe-keeping, the safe including a door and a door hinge for pivotably opening the door for placing the articles within the safe, the safe being anchored to a surface;

an anti-prying device to limit wedging and working of a prying element between the door hinge and the surface, the device being anchored to the surface and including a member positioned between the door hinge and the surface to restrict insertion of the prying element between the door hinge and the surface to prevent stealing of the safe by prying up the door hinge to uproot the safe from its anchorings.

10. The system of claim 9 wherein the member comprises a base portion and a rod, the rod extending away from the base portion between the door hinge and the surface to restrict insertion of the prying element between the door hinge and the surface.

11. The system of claim 9 further comprising a number of apertures in the base and a number of anchors inserted through the apertures to secure the base to the surface.

12. The device of claim 11 wherein the anchors are non-removable bolts.

13. The device of claim 11 wherein the anchors are expandable bolts which are expanded against a hole in the surface to secure the bolts therein.

14. The system of claim 9 wherein the member includes a rod extending co-axially with the door hinge between the door hinge and the surface.

15. The system of claim 14 wherein the rod is sufficiently rigid to prevent being bent by a prying element relative to the axis of the hinge.

16. The system of claim 14 wherein the rod is sufficiently dimensioned to cover an area between the safe door and an outer front portion of the door hinge to prevent a prying element from being inserted between the door and the rod.

17. A method for preventing stealing of a safe caused by inserting a prying element between a door hinge of the safe and a surface to which the safe is anchored, wherein the inserted prying element is then wedged and worked against the hinge and the surface to uproot the anchored safe such that the safe can then be carried away, the method comprising:

providing an anti-prying device having a base and a rod extending from the base;

aligning the anti-prying device such that the rod extends between the door hinge and the surface to restrict insertion of the prying element therebetween; and anchoring the base to the surface once the anti-prying device is aligned.

18. The method of claim 17 wherein aligning the anti-prying element comprises co-axially aligning the rod with the door hinge.

19. The method of claim 17 further comprising anchoring the base after anchoring the safe.

20. A safe system, the system comprising:

a safe for receiving articles for safe-keeping, the safe including a door and a door hinge for pivotably opening the door for placing the articles within the safe, the safe being anchored to a surface;

an anti-prying device to limit wedging and working of a prying element between the door hinge and the surface, the device being anchored to the surface and including a member positioned in close proximity to the door hinge and extending therefrom to the surface to prevent insertion of the prying element between the door hinge and the surface so as to permit opening of the door and to prevent stealing of the safe by prying up the door hinge to uproot the safe from its anchorings.

21. A method for preventing stealing of a safe caused by inserting a prying element between a door hinge of a door of the safe and a surface to which the safe is anchored, wherein the inserted prying element is then wedged and worked against the hinge and the surface to uproot the anchored safe such that the safe can then be carried away, the method comprising:

providing an anti-prying device having a base and a rod extending from the base;

aligning the anti-prying device in close proximity to the door hinge such that the rod extends therefrom to the surface so as to prevent insertion of the prying element between the door hinge and the surface while permitting opening of the door about the door hinge; and anchoring the base to the surface once the anti-prying device is aligned.

* * * * *

UNITED STATES PATENT AND TRADEMARK OFFICE

CERTIFICATE OF CORRECTION

PATENT NO. : 6,923,127 B2
DATED : August 2, 2005
INVENTOR(S) : Mike Smith

It is certified that error appears in the above-identified patent and that said Letters Patent is hereby corrected as shown below:

Column 4,
Line 56, delete "1" and insert therefor -- 2 --.

Signed and Sealed this

Eighteenth Day of October, 2005

JON W. DUDAS
*Director of the United States Patent and Trademark Office*